United States Patent [19]

Beaulieu

[11] Patent Number: 4,727,994

[45] Date of Patent: Mar. 1, 1988

[54] COLLAPSIBLE SUPPORT AND ATTACHMENT STRUCTURE

[75] Inventor: Bryan J. Beaulieu, Burnsville, Minn.

[73] Assignee: Skyline Displays, Inc., Burnsville, Minn.

[21] Appl. No.: 68,104

[22] Filed: Aug. 10, 1987

Related U.S. Application Data

[63] Continuation of Ser. No. 792,122, Oct. 28, 1985, abandoned.

[51] Int. Cl.[4] ..... A47B 47/00

[52] U.S. Cl. ..... 211/198; 211/169; 40/610; 16/333

[58] Field of Search ..... 211/169, 175, 198; 40/601, 603, 610; 16/304, 307, 295, 374, 333, 324, 321; 160/351, 135, 377; 248/460, 463, 155.4, 166

[56] References Cited

U.S. PATENT DOCUMENTS

| | | | |
|---|---|---|---|
| 83,572 | 10/1868 | Walter | 16/307 |
| 1,127,099 | 2/1915 | Shipley | 16/333 X |
| 1,408,079 | 2/1922 | Davis et al. | 160/351 |
| 1,662,586 | 3/1928 | Newman | 211/204 X |
| 2,299,584 | 10/1942 | Low | 16/335 X |
| 2,357,819 | 9/1944 | Greer | 160/351 |
| 2,403,661 | 7/1946 | Hurley | 160/328 |
| 2,598,128 | 5/1952 | Liechty | 297/187 X |
| 2,902,239 | 9/1959 | Janecka, Jr. | 248/165 X |
| 3,002,557 | 10/1961 | Roth et al. | 160/351 |
| 3,180,446 | 4/1965 | Wenger | 248/170 |
| 3,463,218 | 8/1969 | Cannon et al. | 160/135 |
| 3,566,418 | 3/1971 | Carlson et al. | 16/307 X |
| 3,817,396 | 6/1974 | Markson | 211/198 |
| 3,975,850 | 8/1976 | Giaume | 211/198 X |
| 4,030,219 | 6/1977 | Donovan | 211/195 X |
| 4,071,969 | 2/1978 | Tonhäuser | 40/610 |
| 4,116,413 | 9/1978 | Andersen | 248/455 X |
| 4,276,726 | 7/1981 | Derus | 248/166 X |
| 4,288,937 | 9/1981 | Virsen | 248/163.1 X |
| 4,325,197 | 4/1982 | Achten et al. | 40/610 |
| 4,444,240 | 4/1984 | Bannister | 160/135 |
| 4,471,548 | 9/1984 | Goudie | 40/610 |

FOREIGN PATENT DOCUMENTS

| | | | |
|---|---|---|---|
| 217015 | 6/1924 | United Kingdom | 16/333 |

*Primary Examiner*—Randolph A. Reese
*Assistant Examiner*—Anthony Knight
*Attorney, Agent, or Firm*—Paul L. Sjoquist

[57] ABSTRACT

A first reflexively collapsible support and attachment structure for use in portable self-supporting frames for display panels, walls, podiums and tables. A horizontal elongate foot having front and back ends forms the base. Connected to the front end of the foot is a first brace adapted to swing to an inclined position. A biased support strut is provided between the foot and the first brace. The support strut is slidably collapsible and supports the first brace in the inclined position. Second and subsequent braces are interlockingly hinged such as to swing to generally vertical positions. Aligned in parallel fashion is a second like reflexively collapsible structure. The first and second structures are interconnected by at least two horizontal connecting rods. Display panels or sheets are connected between the first and second structures.

15 Claims, 14 Drawing Figures

COLLAPSIBLE SUPPORT AND ATTACHMENT STRUCTURE

This application is a continuation of application Ser. No. 792,122, filed Oct. 28, 1985, now abandoned.

This invention relates to collapsible frames for portable display panels, walls, podiums, tables and the like, and more particularly to a self-supporting reflexively collapsible support and attachment structure for such frames.

Known collapsible self-supporting display panel or wall frames of the type capable of supporting display panels or sheets vertically hung thereon are illustrated by U.S. Pat. Nos. 4,276,726 and 4,471,548. These particular frames characteristically have a network of support rods or spokes which are pivotally joined together at hub assemblies for movement between a collapsed compact position for storage or transportation and an open erect position for usage. Once erect, they may have hardware attached thereto for hanging sheets or panels for either masking the frame or for simply displaying graphic presentations such as for advertising.

Other general types of portable display frames with planar display panels may be seen in U.S. Pat. Nos. 1,408,079; 2,902,239; and 4,325,197. All of these display panel frames are particularly useful for window displays and backdrops or portable walls for trade shows and the like.

However, such frames distinctively have complex mechanical joints and require manual attachment of the display panels to the frames once they have been erected thereby making their assembly and disassembly somewhat time consuming and tedious. They also typically lack vertical supportive strength rendering them generally incapable of supporting more than a vertically hung sheet or panel of material. Furthermore, there are generally no places on the covered frames to mount or attach display accessories such as shelving and lighting customarily used at trade shows.

Portable film projection screen frames are also generally known in the art such as those disclosed in U.S. Pat. Nos. 3,002,557; 2,403,661; 2,357,819; and 1,662,586. Such frames are of limited use because they also lack in vertical supportive strength and connectable attachment hardware for purposes other than film projection.

Still other types of collapsible frames may include frames for portable sound shells such as the frame disclosed in U.S. Pat. No. 3,180,446. Such frames do exhibit vertical supportive strength. However, they are generally complex, bulky and heavy. They also have limited uses and their assembly and disassembly are quite time consuming. Once assembled, they additionally require manual hanging of panels onto the frame and also require panel removal to permit complete disassembly for storage or transportation.

Folding frames for speaker stands or podiums are also known in the art as disclosed in U.S. Pat. No. 2,598,128. But still, such frames are bulky, heavy, complex in nature, and not readily adaptable for other purposes.

SUMMARY OF THE INVENTION

A reflexively collapsible support and attachment structure for use in portable self-supporting frames for display panels, walls, podiums, tables and the like. The structure includes a horizontal elongate foot having front and back ends forming the base of the structure. A first elongate brace is provided having top and bottom ends. The bottom end of the first brace is pivotally connected to the front end of the foot and is suitably adapted to permit the brace to swing upwardly from a collapsed position adjacent the foot to an upright inclined position.

A slidably collapsible support strut is pivotally connected to the foot and slidably connected to the first brace. The strut is biased to an upright extended position between the foot and the first brace to support and hold the first brace in its upright inclined position. The strut is also adapted to be slidably moved at its end connected to the first brace from its extended position to a collapsed position adjacent the foot to permit the first brace to swing downwardly to its collapsed position.

A second elongate brace is provided also having top and bottom ends. An interlocking hinge has its lower leaf attached to the top end of the first brace and its upper leaf attached to the bottom end of the second brace. The hinge is adapted to permit the second brace to swing upwardly from a collapsed position adjacent the first brace to an upright generally vertical position. The hinge has a releasable interlocking latch constructed to hold the braces stationary with respect to each other when they are in their respective upright positions.

To complete the assembly of a portable self-supporting frame uptilizing the structure of the inventory, a second like reflexively collapsible support and attachment structure is aligned in parallel fashion to the first structure. The first and second structures are appropriately adapted to be releasably interconnected to each other by at least two horizontal structure connecting rods, with display panels or sheets appropriately connected therebetween, so that the frame may be collapsed or erected as a unit without disassembly.

When the frame is in its reflexively collapsed compact position, it may be easily erected by lifting or swinging the interconnected pair of first braces from their collapsed positions to their upright inclined positions. The biased struts will slide to their upright extended positions and supportively hold the first braces stationary. The interconnected pair of second braces are then lifted and swung upwardly from their collapsed position to their upright generally vertical positions.

The frame may be eaily collapsed to its compact position for storage or transportation by releasing the interlocking latch of the hinges to swingably lower the first braces to their collapsed positions. The struts are then slidably moved to their collapsed position thereby collapsing the first braces to their collapsed positions adjacent the horizontal feet.

The height of the frame may be advantageously increased by adding parallel pairs of elongate braces (like the second braces) to the frame with additional interlocking hinges to easily construct a frame of desirable height.

Additional horizonal connecting rods, with suitable panels or sheet therebetween, may be releasably interconnected between the first and second structures to add further vertical supportive strength and rigidity to the frame.

The collapsible frames may be beneficially interconnected to one another to make display panels or walls of virtually any substantial width. Additional horizontal connecting rods, with fabric panels appropriately connected therebetween, are suitably connected between pairs of self-supporting frames for simple assembly of portable upright display panels or walls of desirable width.

Still further, the first and second parallel support and attachment structures of the frame may be advantageously adapted for mounting a flat rectangular top with conventional brackets to the top ends of the second braces of the first and second structures to thereby form a table, podium or the like.

DESCRIPTION OF THE PREFERRED EMBODIMENT

Figure 1:
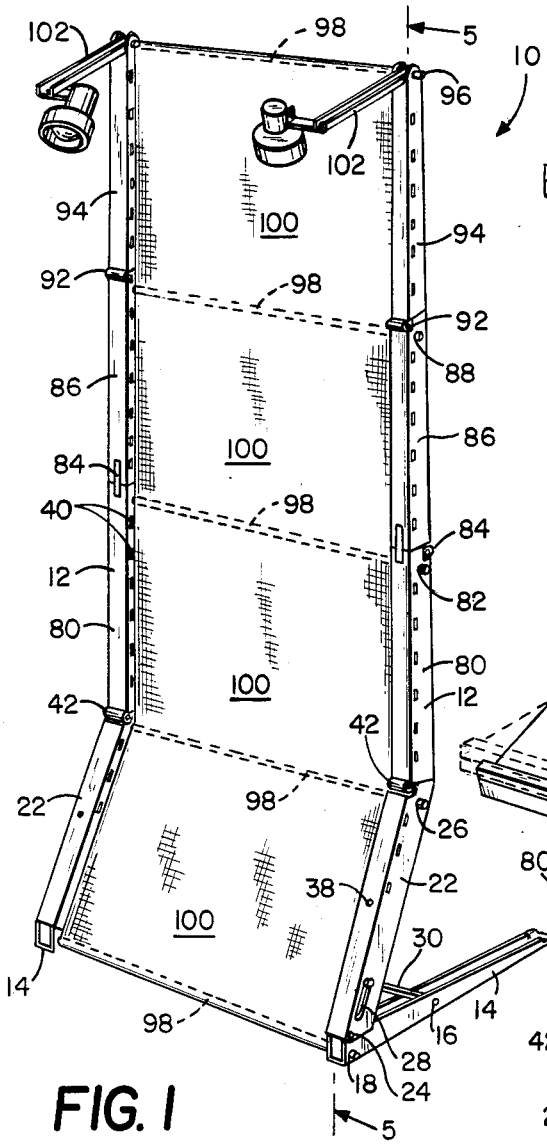
FIG. 1 is a perspective view of a portable display panel or wall.
Figure 2:
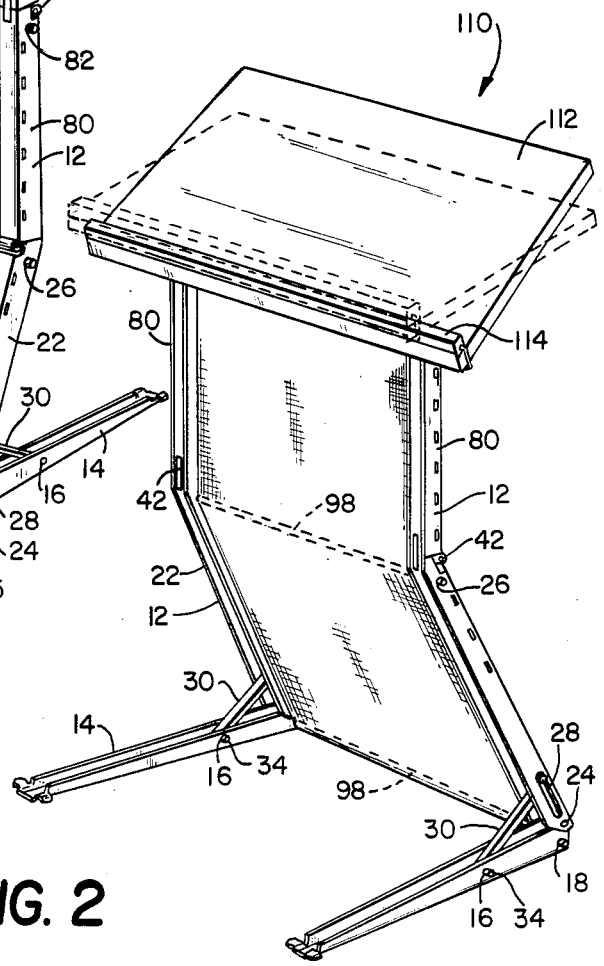
FIG. 2 is a perspective view of a portable podium (and table in broken outline)

Referring to FIGS. 1 and 2, portably self-supporting display panel frame 10 and portable self-supporting podium frame 110 may generally be seen. Frames 10 and 110 each include a like parallel pair of interconnected support and attachment structures 12.

Structure 12 generally includes a horizontal elongate foot 14 pivotally connected to first elongate brace 22. A biased slidably collapsible support strut 30 is connect between the foot 14 and first brace 22. The top end of first brace 22 has an interlocking hinge 42 attached thereto which is in turn attached to the bottom end of a second elongate brace 80. Horizontal structure connecting rods 98, which preferably have fabric panels 100 appropriately connected therebetween, releasably interconnect the like parallel pair of support and attachment structures 12 of frames 10 and 110.

In display panel or wall frame 10 (FIG. 1) additional pairs of elongate braces 86 and 94 are added to expand structures 12. Second braces 80 have a second like interlocking hinges 84 attached to their top ends and to the bottom ends of third elongate braces 86. Second hinges 84 are aligned in reverse pivotal orientation compared to first hinges 42. Third interlocking hinges 92 are attached to the top ends of third braces 86 and to the bottom ends of fourth elongate braces 94. Third hinges 92 are pivotally oriented similarly to first hinges 42 and in reverse orientation compared to second hinges 84 to thereby permit reflexive movement between the pairs of parallel braces 22, 80, 86 and 94.

Portable podium frame 110 (FIG. 2) similarly includes the pair of parallel like structures 12 each having horizontal foot 14, first brace 22, biased slidably collapsible support strut 30, interlocking hinge 42, second brace 80 and horizontal structure connecting rods 9B with panels 100. All are similarly connected as in portable display panel frame 10. The top ends of second braces 80 are suitably adapted for mounting a planar rectangular top 112 in either a horizontal position for a table 120 (FIG. 3) or in an inclined position for a podium 110 (FIG. 2).

Figure 4:
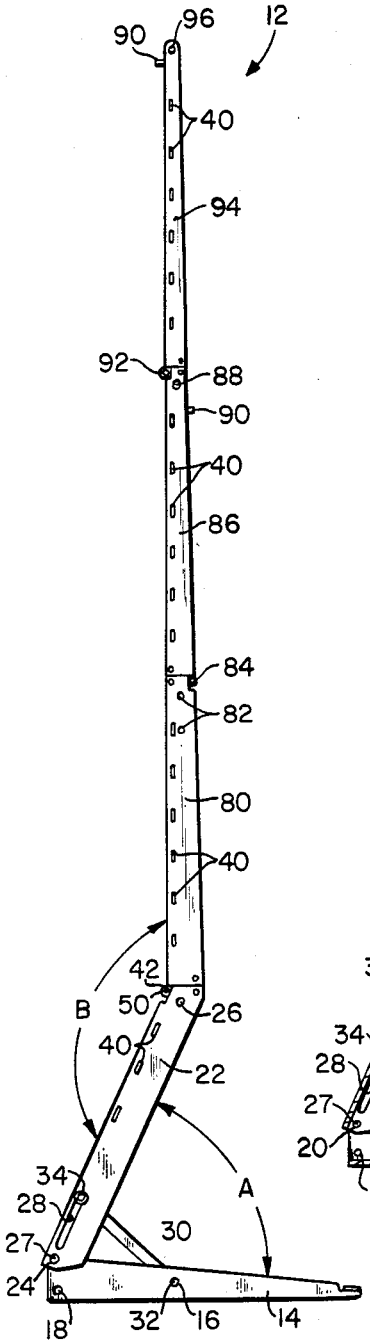
FIG. 4 is a side elevational view of the erect support and attachment structure.
Figure 5:
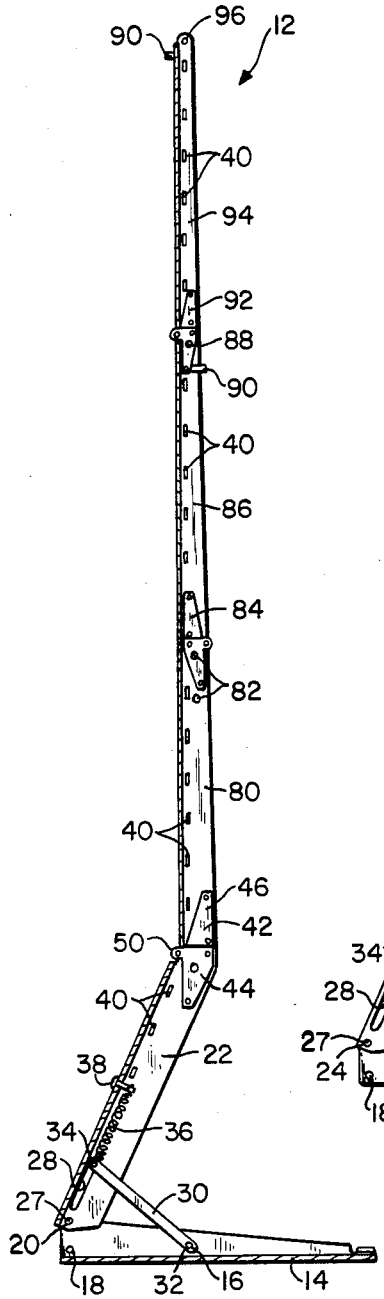
FIG. 5 is a cross-sectional view of the erect structure taken along lines 5—5 of FIG. 1.

Referring to FIGS. 4 and 5, more intricate detail of support and attachment structure 12 may be seen. Horizontal elongate foot 14 is preferably U-shaped in cross-section to add strength to foot 14, with minimal material usage. Foot 14 suitably has two pairs of transversely aligned pivot holes 16 and 20 and a pair of transversely aligned horizontal structure connecting rod mounting holes 18.

First elongate brace 22 is also suitably U-shaped in cross-section for strength and to permit overlap of brace 22 over foot 14 for compact collapse of structure 12. Brace 22 has a pair of transversely aligned holes 24 to be aligned with holes 20 of foot 14 wherethrough pivot pin 27 is suitably located and retained. First brace 22 also has a pair of transversely aligned connecting rod mounting holes 26 (similar to holes 18), a pair of transversely aligned elongate strut mounting slots 28 and a plurality of transversely aligned accessory attachment slots 40.

Slidably collapsible support strut 30 is preferably rigid and has a transversely aligned pivot pin 32 adjacent its lower end. Pivot pin 32 passes through and is retained in pivot holes 16 of foot 14. Strut 30 also has transversely aligned sliding pin 34 adjacent its top end. Sliding pin 34 passes through and is retained in strut mounting slots 28 of first brace 22. By this arrangement, strut 30 pivots on font 14 and will slide upwardly in mounting slots 28 to its extended support position as first brace 22 is swung upwardly to its upright inclined position. Coil spring 36 is suitably connected between sliding pin 34 and spring retaining pin 38 which is mounted in first brace 22. Spring 36 biases strut 30 towards its upright inclined position thereby automating the erection of structure 12 and preventing inadvertent collapse of first brace 22. When structure 12 is in its erect position, angle "A" between foot 14 and first brace 22 is approximately 65°.

The top end of first brace 22 has lower leaf 44 of first interlocking hinge 42 suitably attached thereto such as by rivets or screws. The upper leaf 46 of hinge 42 is also suitably attached to the bottom end of second elongate brace 80 which is preferrably U-shaped in cross section.

The novel construction of interlocking hinge 42 may be more clearly seen in FIGS. 6, 7, 8, and 9. Interlocking hinge 42 has lower leaf 44, which is comprised of parallel plates 44*a* and 44*b*, and upper leaf 46, which is comprised of parallel plates 46*a* and 46*b*. Lower leaf 44 and upper leaf 46 are pivotally interconnected by hinge pin 50 which has a threaded passage therethrough. Conventional screws 56 threadable within hinge pin 50, suitably hold lower and upper leafs 44 and 46 on hinge pin 50. Hinge pin 50 preferably supports spacer roller 52 and friction washers 54 which are between respective plates 44a, 46a and 44b, 46b of lower and upper leafs 44 and 46.

Upper leaf plates 46a and 46b appropriately have retaining flanges 48, latch pivot pin 58 therebetween, which also has a threaded passage therethrough, and traversely aligned hinge mounting holes 70. Lower leaf plates 44a and 44b appropriately support notch pin 60 therebetween, which also has a threaded passage therethrough, transversely aligned hinge mounting holes 70 and connecting rod mounting holes 72 which are to be aligned with rod mounted holes 26 on first braces 22. Pins 58 and 60 are preferably parallel to hinge pin 50.

Elongate latch 62, which is suitably U-shaped in cross-section, is pivotally mounted on latch pin 58 in transverse alignment with hinge pin 50. Latch 62 has a tapered end adjacent lower leaf 44 with notch 64 thereat. Latch 62's tapered end is constructed to be slidable over notch pin 60 and to cooperatively permit notch 64 to interlock with notch pin 60. A pair of retaining ears 66 are on the other end of latch 62 and are constructed to strike retaining flanges 48 to prevent further outward rotational movement of latch 62 beyond flanges 48. Conventional coil spring 68 with extending ends is suitably mounted on latch pin 58 under tension with its ends appropriately confined between the inside of latch 62 and roller 52 thereby biasing latch 62 for outward rotational movement thereby cooperatively holding notch 64 in contact with notch pin 60 in an interlocking relationship. This relationship may be released by pressing or moving latch 62 adjacent ears 66 in an inward rotational direction towards pin 50 thereby disengaging notch 64 and notch pin 60 to permit the collapse of second brace 80 to a position adjacent first brace 22.

The interlocking hinges 42, 84 and 92 within vertically expanded structure 12 are of similar construction. They may be easily attached to the ends of braces 22, 80, 86 and 94 by rivits passing through the respective braces and mounting holes 70 and by conventional screws 56 passing through the respective braces and into interiorly threaded latch and notch pins 58 and 60.

Again referring to FIGS. 4 and 5, second brace 80 has its lower end attached to upper leaf 46 of interlocking hinge 42. Second brace 80 has two pairs of transversely aligned connecting rod mounting holes 82 (which also suitably may be used for mounting retangular top 112 discussed hereinafter) and a plurality of tranversely aligned accessory attachment slots 40. Angle "B" between first brace 22 and second brace 80 is approximately 150° when structure 12 is in its erect upright position. Angles "A" and "B" are such to permit foot 14 and first brace 22 to add vertical supportive strength to structure 12 while yet requiring minimal materials and spatial requirements.

To vertically expand structure 10, second brace 80 at its top end suitably has a second interlocking hinge 84 attached thereat with its pivotal swing orientation in reverse direction as first interlocking hinge 42 to permit reflexive collapse and erection of structure 12. Third brace 86, also preferably U-shaped in cross-section, has a pair of transversely aligned connecting rod mounting holes 88 along with a plurality of transversely aligned accessory attachment slots 40.

Latch release button 90 is appropriately adjacent to the top end of third brace 86. When latch 62 of second hinge 84 is released from engagement with latch pin 60, third brace 86 will swing downwardly and permit aligned release button 90 to cooperatively depress latch 62 of first interlocking hinge 42 inwardly against biasing spring 68 to release the interlocking relationship of pin 60 and notch 64 to thereby unlock hinge 42 and automate the collapse of expanded structure 12.

Third interlocking hinge 92 is suitably attached to the top of third brace 86 and has its pivotal swing oreintation in the same direction as first hinge 42 while being in reverse direction compared to second hinge 84 to permit reflexive collapse and erection of expanded structure 12. Fourth brace 94, preferably U-shaped in cross-section, has its lower end suitably attached to third interlocking hinge 92. Fourth brace 94 suitably has a plurality of traversely aligned accessory attachment slots 40 and a pair of transversely aligned connecting rod mounting holes 96. Another latch release button 90 is appropriately adjacent to the top end of fourth brace 94. When latch 62 of third hinge 92 is manually released from engagement with latch pin 60, fourth brace 94 will swing downwardly and permit aligned release button 90 or fourth brace 94 to cooperatively depress latch 62 of second interlocking hinge 84 inwardly against its biasing spring 68 to release the interlocking relationship of pin 60 and notch 64 to thereby unlock hinge 84 and further automate the collapse of expanded structure 12.

As shown in FIGS. 1 and 2, horizontal structure connecting rods 98, preferably having fabric sheets or panels 100 conventionally connected therebetween. Panels 100 suitably may have graphic presentations printed thereon for display or advertising purposes. Aternatively, panels 100 may simply be blank to visibly mask frame 10 or 110 from a viewer's eye for aesthetic appeal.

Rods 98 suitably interconnect a like pair of parallel support and attachment structures 12 by having opposing ends of rods 98 passing through transversely aligned connecting rod mounting holes 18, 26, 82, 88, and 96 respectively located in foot 14 and braces 22, 80, 86 and 94 of like parallel structures 12. Mounting holes 18, 26, 82, 88 and 96 are preferably adequately spaced apart to hold panels 100 tautly when frame 10 is in its erect position. The ends of rods 98 are releasably held thereat in a conventional manner such as by retaining clips, threaded caps, etc. The ends of rods 98 also rotate within holes 18, 26, 82, 88 and 96 to permit the reflexive collapse of frame 10 without disconnection of rods 98 from parallel structures 12.

Figure 14:
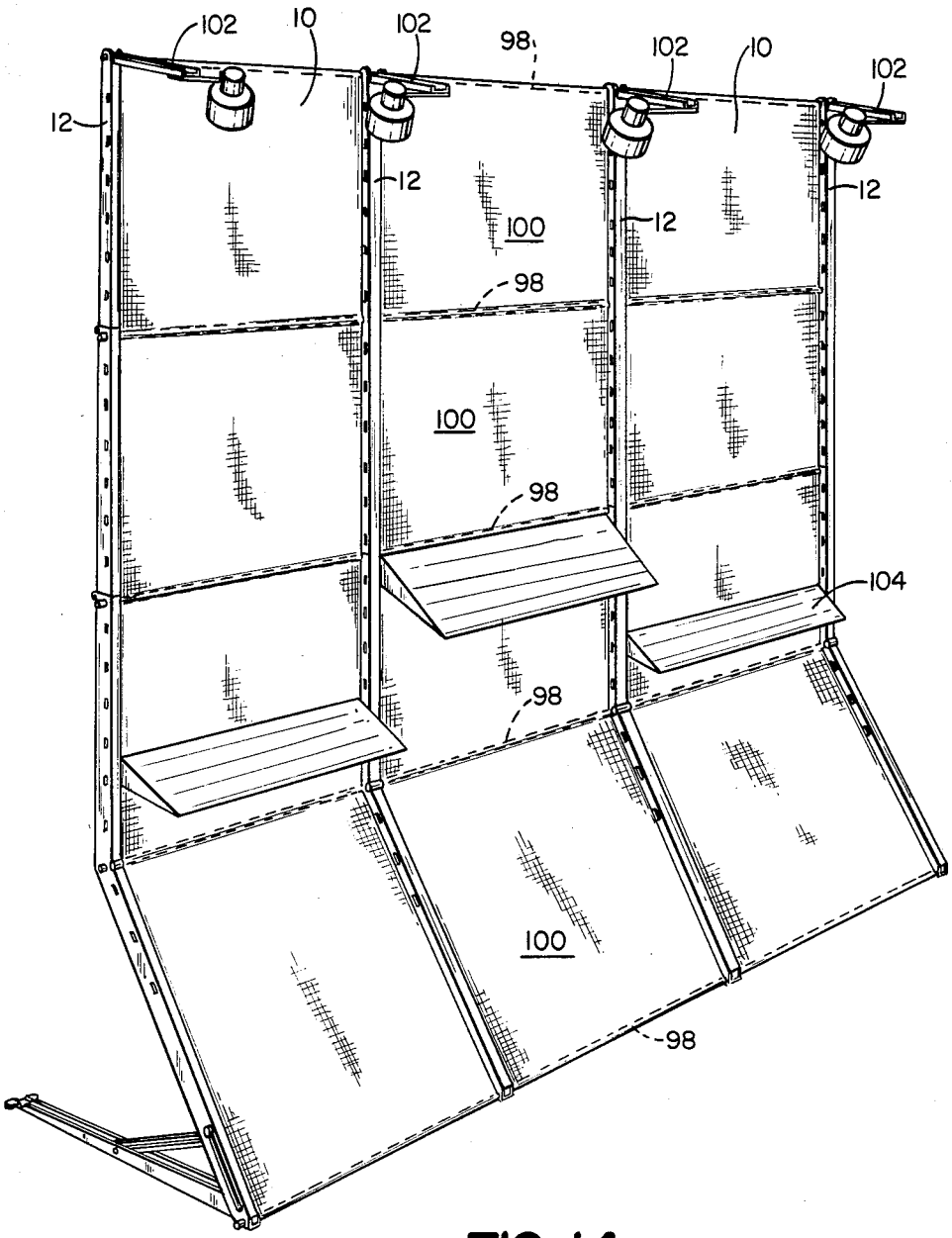
FIG. 14 is a perspective view of a pair of interconnected portable self-supporting display panel frames.

In FIGS. 1 and 14, conventional light fixtures 102 may be suitably mounted to structures 12 by mounting brackets with holes cooperatively aligned with mounting holes 96 in fourth braces 94. The ends of rods 98 may then suitably pass through mounting brackets of light fixtures 102 and mounting holes 96 in a manner that will preferably will permit pivotal movement of light fixtures 102. Shelves 104 (FIG. 14) with conventionally known brackets may be appropriately mounted on display panel frame 10 in a releasable interlocking relationship with horizontally aligned pairs of accessory attachment slots 40 in parallel structures 12.

Referring to FIGS. 10, 11, 12 and 13, the reflexive collapsing operation of vertically expanded structure 12 may illustratively be seen in several stages. However, it should be noted that the entire panel frame 10 may be collapsed as a unit because horizontal structure connecting rods 98 with fabric panels 100 (not shown) are adapted to cooperatively permit the collapse and erection operations of complete panel frame 10 without disassembly.

Figure 10:
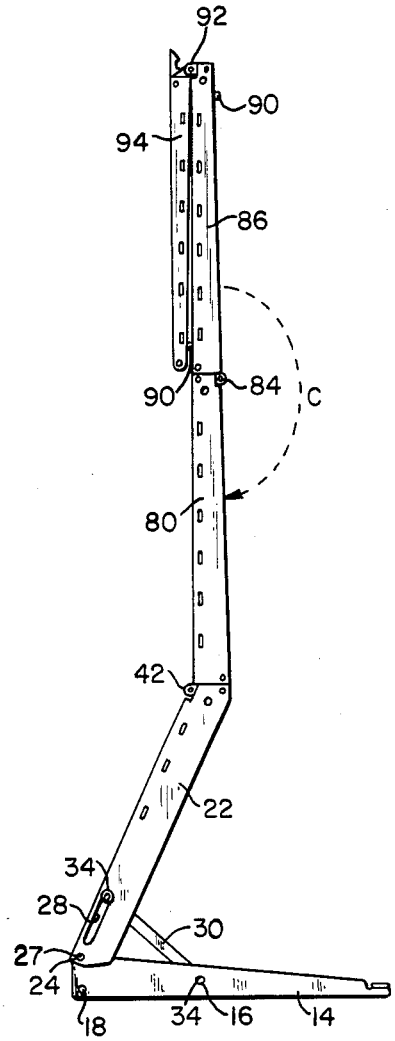
FIG. 10 is a side elevational view of the structure with its fourth brace in its collapsed position.
Figure 6:
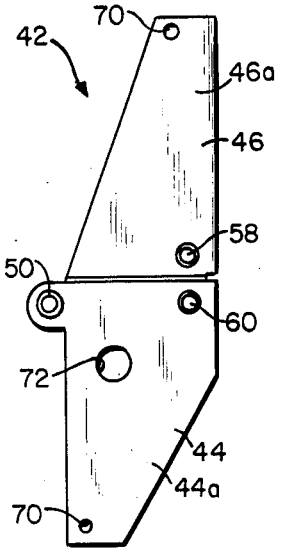
FIG. 6 is a side elevational view of an interlocking hinge of the structure.
Figure 7:
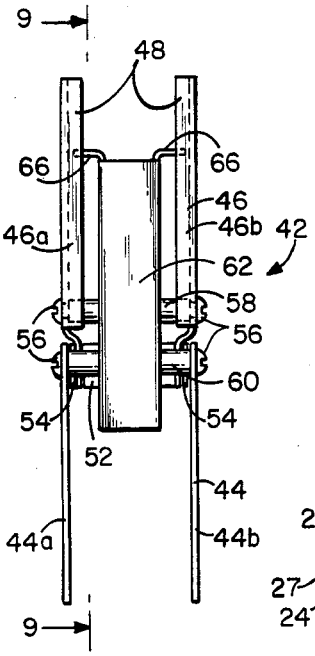
FIG. 7 is a front elevational view of the interlocking hinge.
Figure 11:
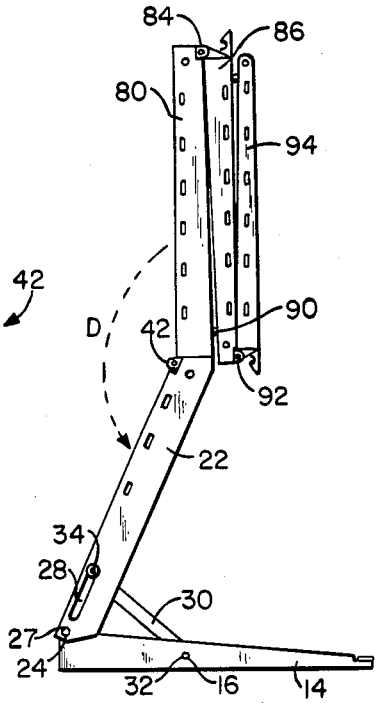
FIG. 11 is a side elevational view of the structure with the third and fourth braces in their respective collapsed positions.
Figure 8:
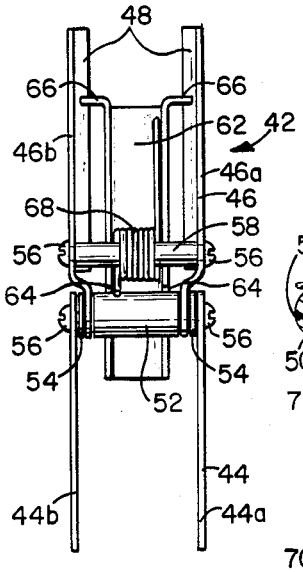
FIG. 8 is a rear elevational view of the interlocking hinge.
Figure 9:
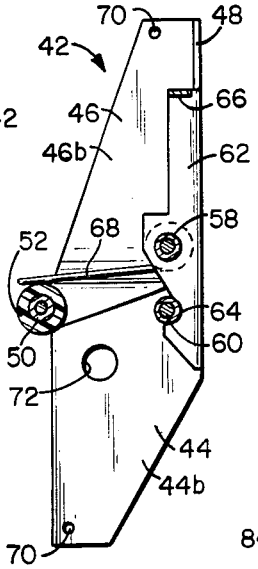
FIG. 9 is a cross-sectional view of the interlocking hinge taken along lines 9—9 of FIG. 7.
Figure 12:
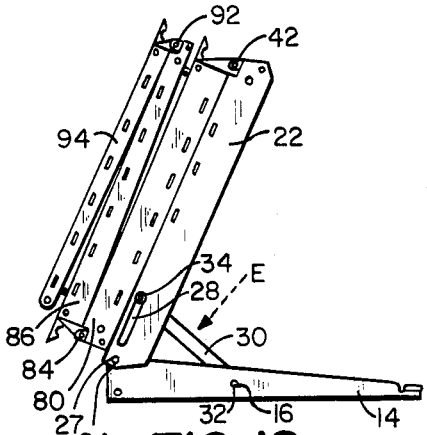
FIG. 12 is a side elevational view of the structure with the second, third, and fourth braces in their respective collapsed position.
Figure 13:
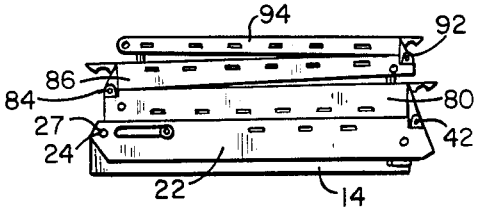
FIG. 13 is a side elevational view with the structure in its collapsed compact position for easy storage or transportation.

As fourth brace 94 is swung downwardly to its collapsed position adjacent third brace 86, latch release button 90 on brace 94 cooperatively depresses interlocking hinge latch 62 of second hinge 84 to thereby permit third brace 86 to reflexively swing downwardly in the direction of arrow "C" its collapsed position (FIGS. 10 and 11). As third brace 86 swings downwardly, latch release button 90 on brace 86 cooperatively depresses interlocking hinge latch 62 of first hinge 42 thereby permitting second brace 80 to reflexively swing downwardly in the direction of arrow "D" to its collapsed position adjacent first brace 22 (FIGS. 11 and 12). Manually depressing strut 30 in the direction of arrow "E" will move sliding pin 34 downwardly in elongate slot 28 against biasing spring 36 and will permit first brace 22 to swing downwardly to its collapsed position adjacent foot 14 (FIGS. 12 and 13).

Referring to FIG. 14, a pair of portable display panel frames 10 are shown supporting additional horizontal structure connecting rods 98 with fabric panels 100 suitably adjacent connecting rods 98 of frame 10. By this arrangement, interconnected portable display panel frames 10 may be quickly assembled to any desirable width.

Figure 3:
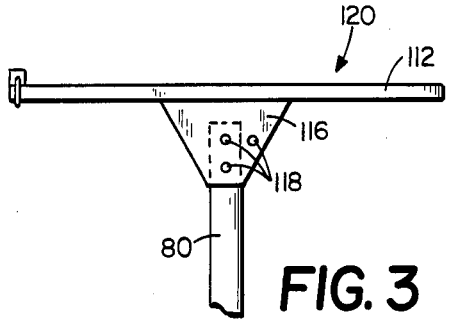
FIG. 3 is a broken away side elevational view of the table of FIG. 2.

Referring to FIGS. 2 and 3, portable podium frame 110 has an adjustable planar rectangular top 112 with removable pencil/paper retaining bar 114 and parallel top mounting brackets 116 (FIG. 3). Brackets 116 have aligned mounting holes 118. Top 112 may be mounted on second braces 80 by suitably aligning mounting holes 118 with holes 82 on second braces 80 and appropriately passing conventional pins therethrough. One such alignment may permit an inclined position of top 112 to create a portable podium 110. Alternatively, mounting holes 118 and 82 may be aligned to permit top 112 to be in a horizontal position thereby creating a portable table 120.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

That which is claimed is:

1. A reflexively collapsible, portable, self-supporting structure for display panels, walls, podiums, tables, and the like, comprising at least two sides each side having (a) footing means for supporting the structure;

(b) a first brace, said first brace attached to said footing means;

(c) a second brace, said second brace pivotably attached to said first brace so that said second brace is pivotable in a first direction;

(d) a first releasable locking means for releasably locking said first brace to said second brace, said first releasable locking means connected to said first and second braces;

(e) a third brace, said third brace pivotably attached to said second brace so that said third brace is pivotable in a second direction, said third brace having a first aligned release button;

(f) a second releasable locking means for releasably locking said second brace to said third brace, said second releasable locking means connected to said second and third braces, said second releasable locking means spaced equidistance from said first releasable locking means and said first aligned release button;

(g) a further brace, said further brace pivotably attached to said third brace so that said further brace is pivotable in said first direction, said further brace having a further aligned release button; and (h) a third releasable locking means for releasably locking said third brace to said further brace, said third releasable locking means connected to said third and further braces, said third releasable locking means spaced equidistance from said second releasable locking means and said further aligned release button whereby the structure is collapsible by releasing said third releasable locking means, which allows said further brace to pivot and said further aligned release button to automatically and reflexively cooperate with and release said second releasable locking means, which in turn allows said third brace to pivot and said first aligned release button to automatically and reflexively cooperate with and release said first locking means, which in turn allows said second brace to pivot to reduce the structure to a collapsible form.

2. The invention of claim 1 wherein said first releasable locking means comprises:

(a) a pin, said pin being rigidly attached to said first brace; and (b) a pivotable latch, said latch being pivotably attached to said second brace, said latch being lockable to said pin so that said first brace is lockable to said second brace, said latch being pivotable by said first aligned release button to release said latch from said pin so that said first releasable locking means is releaseed and said second brace may pivot toward said first brace in said first direction.

3. The invention of claim 1, wherein said second releasable locking means comprises:

(a) a pin, said pin being rigidly attached to said second brace; and (b) a pivotable latch, said latch being pivotably attached to said third brace, said latch being lockable to said pin so that said second brace is lockable to said third brace, said latch being pivotable by said further aligned release button to release said latch from said pin so that said second releasable locking means is released and said third brace may pivot toward said second brace in said second direction.

4. The invention of claim 1 wherein said third releasable looking means comprises:

(a) a pin, said pin being rigidly attached to said third brace; and (b) a pivotable latch, said latch being pivotably attached to said fourth brace, said latch being lockable to said pin so that said third brace is lockable to said fourth brace, said latch being manually pivotable to release said latch from said pin so that said third releasable locking means is released and said further brace may pivot toward said third brace in said first direction.

5. The invention of claim 1, wherein said footing means comprises a support strut and a foot, said support strut slidably connected to said first brace and pivotably connected to said footing means.

6. The invention of claim 5, wherein said first brace and said foot form an acute angle.

7. The invention of claim 1, wherein said second direction is opposite to said first direction.

8. The invention of claim 1, wherein said first brace and said second brace form an obtuse angle.

9. The invention of claim 1, further comprising a plurality of aligned slots in said braces, said slots adapted for releasably attaching display accessories to said structure.

10. The invention of claim 1, wherein said second brace is adaptable for mounting thereon a planar top for a table, podium and the like.

11. The invention of claim 1, wherein said fourth brace is adaptable for mounting thereon a light fixture.

12. The invention of claim 1, further comprising a connecting rod, said connecting rod releasably interconnecting said at least two sides.

13. The invention of claim 12, further comprising a panel for graphic representations and masking said frame, said panel being connected to said rod, said rod and panel being adapted to accommodate collapsed and erect positions of said structures while being interconnected therebetween.

14. The invention of claim 1, wherein said braces and said foot are U-shaped in cross-section.

15. A method for reflexively collapsing a portable, selfsupporting structure for display panels, walls, podiums, tables and the like, the structure having a foot for supporting the structure, a first brace attached to the foot, a second brace pivotallly attached to the first brace, a first releasable locking means releasably locking the first and second braces, a third brace pivotally attached to the second brace, a first aligned release button attached to the third brace, a second releasable locking means releasably locking the second and third braces and spaced equidistance from the first releasable locking means and the first aligned release button, a further brace pivotally attached to said third brace, a further aligned release button attached to the further brace, and a third releasable locking means releasably locking the third and further braces and spaced equidistance from the second releasable locking means and the further aligned release button, comprising:

(a) releasing said third releasable locking means;

(b) pivoting said further brace in a first direction after said third releasable locking meana has been released;

(c) permitting said further aligned release button on said further brace to cooperate with said second releasable locking means, thereby automatically and reflexively releasing said second releasable locking means as said further brace pivots and swings into contact with said third brace;

(d) pivoting said third brace in a second direction after said second releasable locking means has been released, said second direction being different from said first direction;

(e) permitting said first aligned release button on said third brace to cooperate with said first releasable locking means, thereby automatically and reflexively releasing said first releasable locking means as said third brace pivots and swings into contact with said second brace;

(f) pivoting said second brace in said first direction to contact with said first brace and said foot, said second brace to be pivoted after said first releasable locking means has been released to thereby collapse the structure to a portable form.

* * * * *